US007387053B2

(12) United States Patent
Lee

(10) Patent No.: US 7,387,053 B2
(45) Date of Patent: Jun. 17, 2008

(54) DRIVING TOOL HAVING ADJUSTABLE HOLDING DEVICE

(75) Inventor: Wan Yen Lee, Taichung (TW)

(73) Assignee: Tien I Industrial Co., Ltd., Taichung (TW)

( * ) Notice: Subject to any disclaimer, the term of this patent is extended or adjusted under 35 U.S.C. 154(b) by 0 days.

(21) Appl. No.: 11/699,179

(22) Filed: Jan. 29, 2007

(65) Prior Publication Data

US 2007/0214916 A1 Sep. 20, 2007

(30) Foreign Application Priority Data

Mar. 20, 2006 (TW) ..... 95204559 U

(51) Int. Cl.
*B25B 23/16* (2006.01)
*B25G 1/00* (2006.01)

(52) U.S. Cl. ..... 81/177.1; 81/177.85

(58) Field of Classification Search ..... 81/177.1, 81/177.2, 177.85, 177.5, 73, 436, 438
See application file for complete search history.

(56) References Cited

U.S. PATENT DOCUMENTS 1,864,466 A * 6/1932 Peterson ..... 81/177.85
2,071,543 A * 2/1937 Kress ..... 81/177.1
RE24,623 E * 3/1959 Capelle ..... 81/436
2,896,489 A * 7/1959 Madsen ..... 81/124.1
2,963,930 A * 12/1960 Clothier et al. ..... 81/177.2
4,092,753 A 6/1978 Fuhrmann
4,781,085 A * 11/1988 Fox, III ..... 81/177.85
5,749,272 A 5/1998 Phan
5,806,381 A 9/1998 Lin
5,852,960 A * 12/1998 Wu ..... 81/177.5
6,006,632 A * 12/1999 Hsieh ..... 81/177.85
6,089,133 A * 7/2000 Liao ..... 81/438
6,523,441 B2 * 2/2003 Lee ..... 81/177.85
6,901,827 B1 * 6/2005 Yen ..... 81/177.85

* cited by examiner

*Primary Examiner*—Hadi Shakeri
(74) *Attorney, Agent, or Firm*—Charles E. Baxley

(57) ABSTRACT

A driving tool includes a driving stem having two or more outer peripheral grooves, a holding device having a tubular member slidably engaged onto the driving stem, a detent slidably received in the tubular member, and an actuating device having a control ferrule slidably engaged onto the tubular member and having an actuator for selectively actuating the detent to engage with either of the peripheral grooves of the driving stem and for adjustably attaching the tubular member to the driving stem at any selected position and for allowing the user to hold the driving tool at suitable or selected position when the driving stem is driven or rotated relative to the tubular member.

17 Claims, 7 Drawing Sheets

DRIVING TOOL HAVING ADJUSTABLE HOLDING DEVICE

BACKGROUND OF THE INVENTION

1. Field of the Invention

The present invention relates to a driving tool, and more particularly to a driving tool including a hand holding device rotatably and adjustably attached to a driving stem for allowing the user to hold the driving tool at any suitable or selected position when the driving stem is driven or rotated relative to the tubular member.

2. Description of the Prior Art

Typical driving tools, such as drilling tools, wrenches, screw drivers or other ratchet driving tools comprise a handle attached to a driving shank for rotating or driving the driving shank to drive various fasteners or tool members, and a holding sleeve rotatably attached onto the outer portion of the driving shank for allowing the driving shank to be suitably rotated or driven by the user.

For example, U.S. Pat. No. 4,092,753 to Fuhrmann discloses one of the typical drill and screwdriver combinations comprising a holding sleeve rotatably attached onto a lower portion or a free end portion of a hollow cylindrical and annular shaft for allowing the hollow cylindrical and annular shaft to be suitably rotated or driven by the user.

However, the holding sleeve is attached onto the lower portion or the free end portion of the hollow cylindrical annular shaft and may not be adjusted up and down along the hollow cylindrical annular shaft such that the user may not hold or grasp the suitable or selected portion of the hollow cylindrical annular shaft.

U.S. Pat. No. 5,749,272 to Phan discloses another typical ratchet screw driver comprising a shroud rotatably attached onto a middle portion of a shaft for allowing the shaft to be suitably rotated or driven by the user. However, similarly, the shroud is attached onto the middle portion of the shaft and may not be adjusted up and down along the shaft such that the user may not hold or grasp the suitable or selected portion of the shaft.

U.S. Pat. No. 5,806,381 to Lin discloses a further typical ratchet screw driver assembly comprising a barrel rotatably attached onto a lower portion of a driving stem for allowing the driving stem to be suitably rotated or driven by the user. However, similarly, the barrel is attached onto the lower portion of the driving stem and may not be adjusted up and down along the driving stem such that the user may not hold or grasp the suitable or selected portion of the driving stem.

The present invention has arisen to mitigate and/or obviate the afore-described disadvantages of the conventional holding devices for driving tools.

SUMMARY OF THE INVENTION

The primary objective of the present invention is to provide a driving tool including a hand holding device rotatably and adjustably attached to a driving stem for allowing the user to hold the driving tool at any suitable or selected position when the driving stem is driven or rotated relative to the tubular member.

In accordance with one aspect of the invention, there is provided a driving tool comprising a driving stem including a first peripheral groove and at least one second peripheral groove formed in an outer peripheral portion thereof, and including a driving shank provided on one end thereof, a holding device including a tubular member having a bore formed therein for slidably receiving the driving stem and for allowing the tubular member to be moved along the driving stem, the tubular member including an orifice formed therein and communicating with the bore of the tubular member, a detent slidably received in the orifice of the tubular member, and an actuating device including a control ferrule slidably engaged onto the tubular member and having an actuator provided on the actuating device for engaging with the detent and for selectively actuating the detent to engage with either of the first peripheral groove or the second peripheral groove of the driving stem and for adjustably attaching the tubular member of the holding device onto the driving stem at any selected position.

The control ferrule includes an inner peripheral depression formed therein for selectively receiving the detent and for allowing the detent to be selectively disengaged from the first and the second peripheral grooves of the driving stem and for allowing the tubular member to be moved or adjusted along the driving stem.

The control ferrule includes a spring member received therein for engaging with the tubular member and for biasing the actuator of the control ferrule to engage with the detent. The tubular member includes a retaining ring attached thereto and engaged with the spring member for retaining the spring member between the tubular member and the control ferrule.

The control ferrule includes a soft outer covering provided on an outer peripheral portion thereof for being comfortably held by a user. The tubular member includes an outer peripheral recess formed in an outer peripheral portion thereof for forming a diameter-reduced neck portion and for slidably engaging with the control ferrule.

The tubular member includes a compartment formed therein and communicating with the bore thereof for receiving at least one gasket, the gasket is engaged between the driving stem and the tubular member.

The driving stem includes a second detent slidably engaged in the driving shank, and an actuating rod slidably engaged in the driving shank and engageable with the second detent for selectively actuating the second detent to partially move out of the driving shank.

The actuating rod includes a depression formed therein for selectively receiving the second detent and for allowing the second detent to be selectively engaged into the driving shank. The driving stem includes a spring member received therein for engaging with the actuating rod and for biasing the actuating rod to engage with the second detent.

The driving stem includes a barrel slidably engaged onto the driving stem and a bar extended into the driving stem and engaged with the barrel and engaged with the actuating rod for selectively moving the actuating rod relative to the driving stem and against the spring member and for allowing the second detent to be selectively received in the depression of the actuating rod.

The driving stem includes at least one magnetic attracting member detachably attached thereto. The driving stem includes an opened lower portion having an inner thread formed therein, and the magnetic attracting member includes an outer thread formed thereon for engaging with the inner thread of the driving shank and for coupling the magnetic attracting member to the driving stem.

The driving stem includes a handle selectively attached to the driving stem for rotating the driving stem relative to the tubular member of the holding device. The handle includes a stud, and a third detent slidably engaged in the stud, and an actuating rod slidably engaged in the stud and engageable with the third detent for selectively actuating the third detent to partially move out of the stud.

The actuating rod includes a depression formed therein for selectively receiving the third detent and for allowing the third detent to be selectively engaged into the stud. The handle includes a spring member received in the stud for engaging with the actuating rod and for biasing the actuating rod to engage with the third detent.

The handle includes a barrel slidably engaged onto the stud and a bar extended into the stud and engaged with the barrel and engaged with the actuating rod for selectively moving the actuating rod relative to the driving stem and against the spring member and for allowing the third detent to be selectively received in the depression of the actuating rod.

The driving stem includes an engaging cavity formed therein for receiving the stud of the handle, and at least one opening formed in the driving stem and communicating with the engaging cavity of the driving stem for detachably coupling the stud of the handle to the driving stem.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
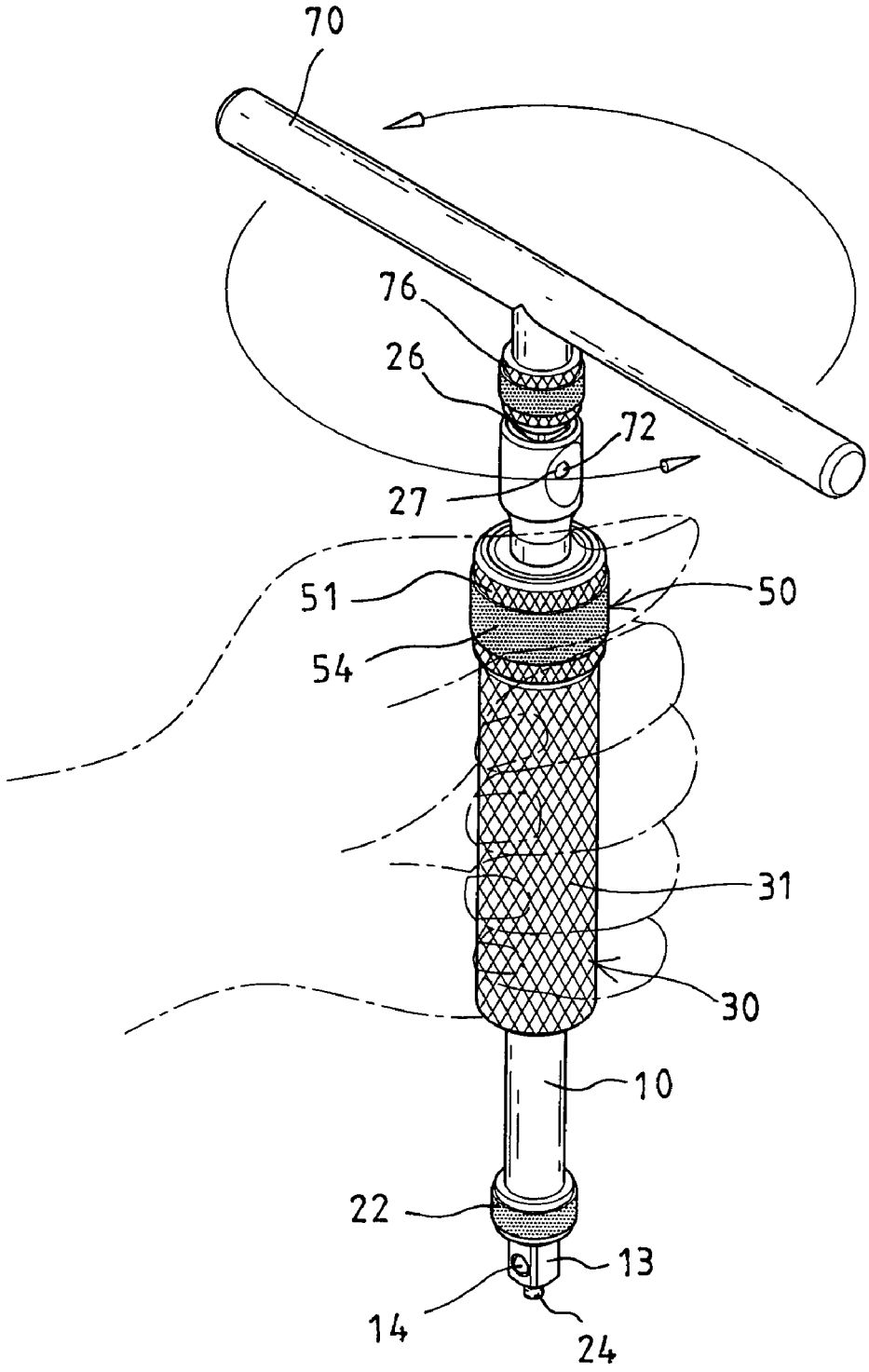
FIG. 1 is a perspective view of a driving tool in accordance with the present invention.

Referring to the drawings, and initially to FIGS. 1-5, a driving tool 1 in accordance with the present invention comprises a driving stem 10 including one, two (FIG. 2), three, four (FIGS. 4, 5) or more peripheral grooves 11, 12 formed or provided on the outer peripheral portion thereof and preferably, but not necessarily equally spaced from each other for adjustably attaching or coupling a hand holding device 30 onto the driving stem 10. The hand holding device 30 includes a sleeve or cylindrical or tubular member 31 having a longitudinal bore 32 formed therein for slidably receiving or engaging onto the driving stem 10 and for allowing the tubular member 31 of the hand holding device 30 to be moved or slid or adjusted along the driving stem 10.

Figures 2, 3:
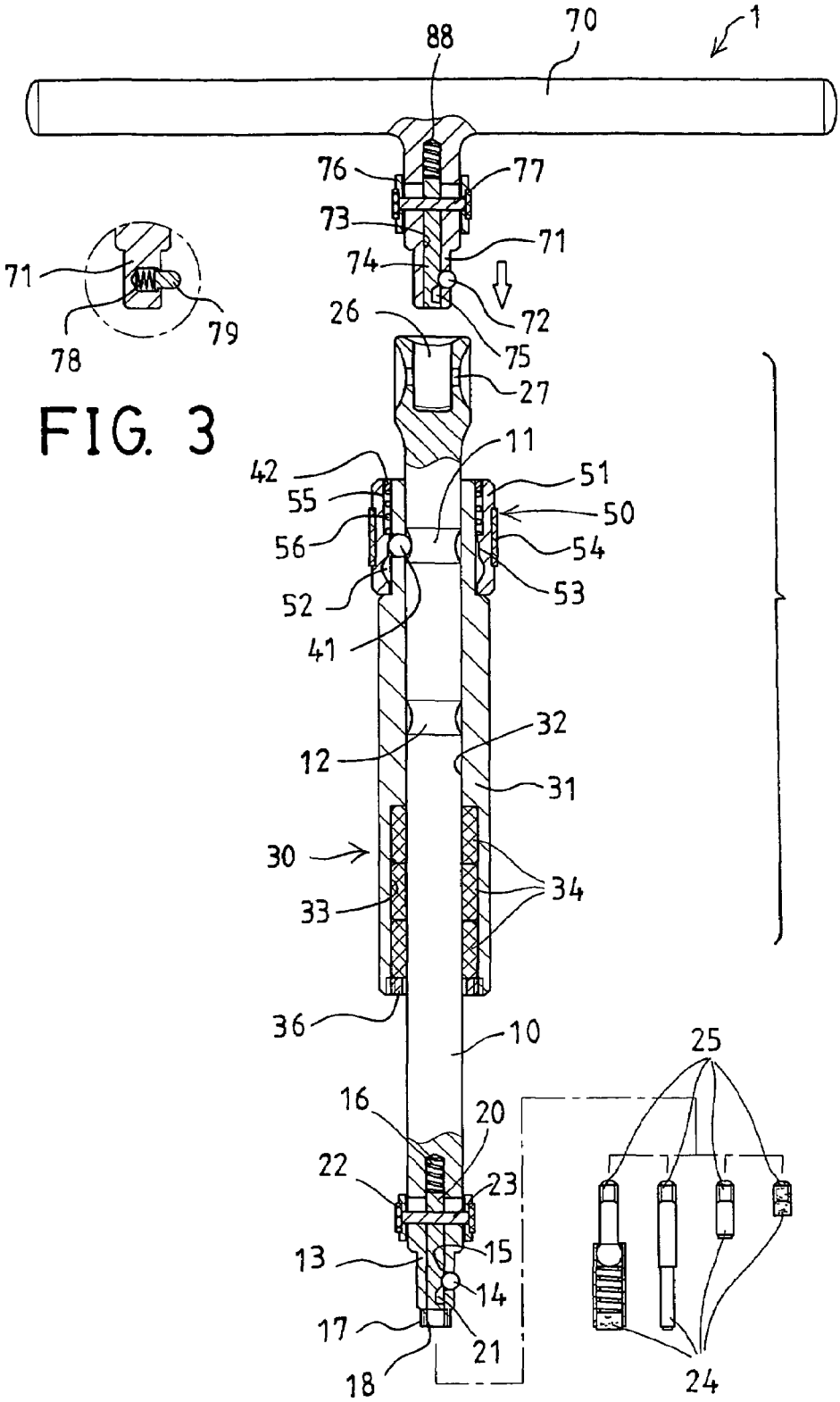
FIG. 2 is a partial exploded view of the driving tool.
FIG. 3 is an enlarged partial cross sectional view illustrating the other arrangement of the driving tool.
Figure 4:
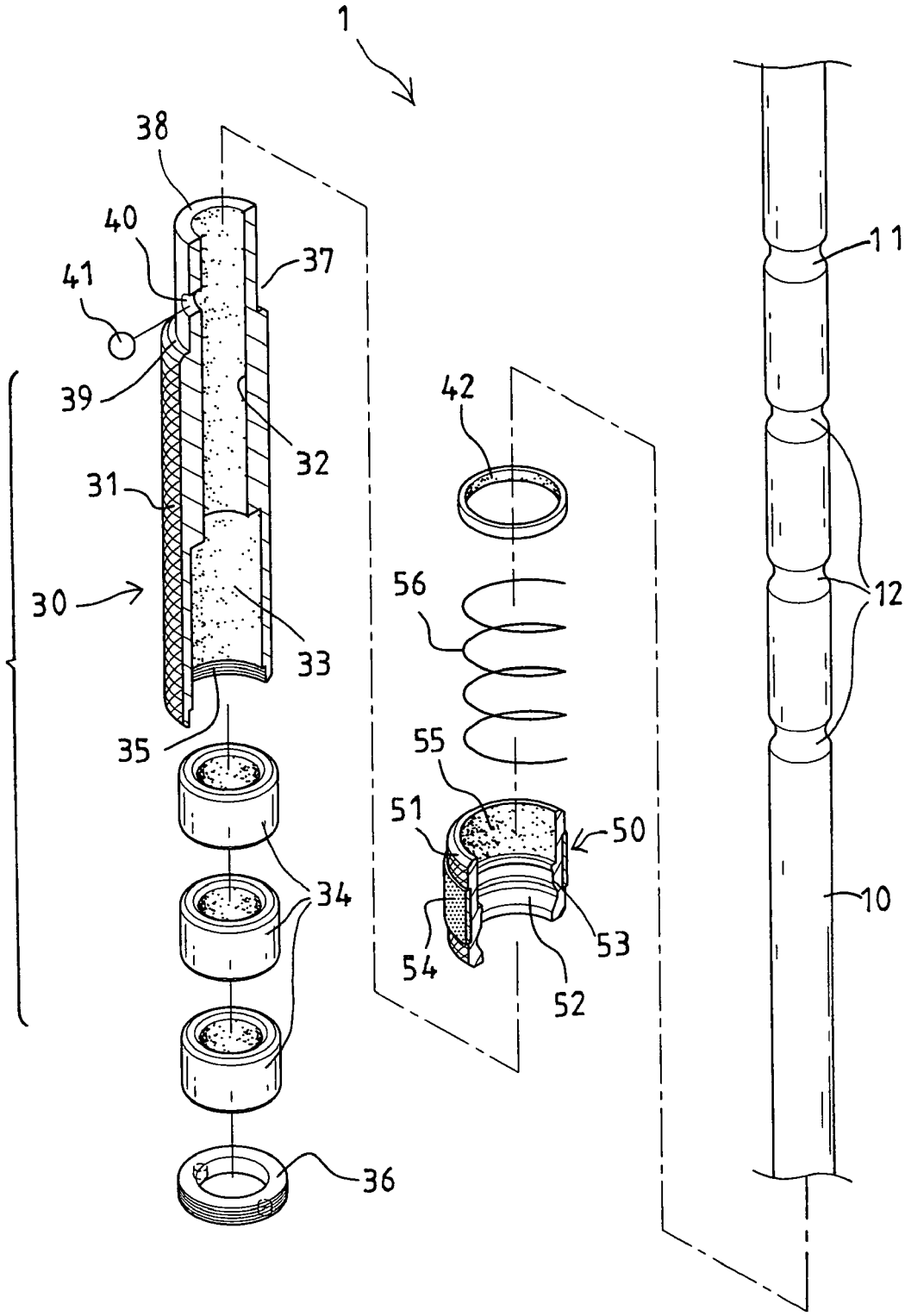
FIG. 4 is another partial exploded view of the driving tool.
Figure 5:
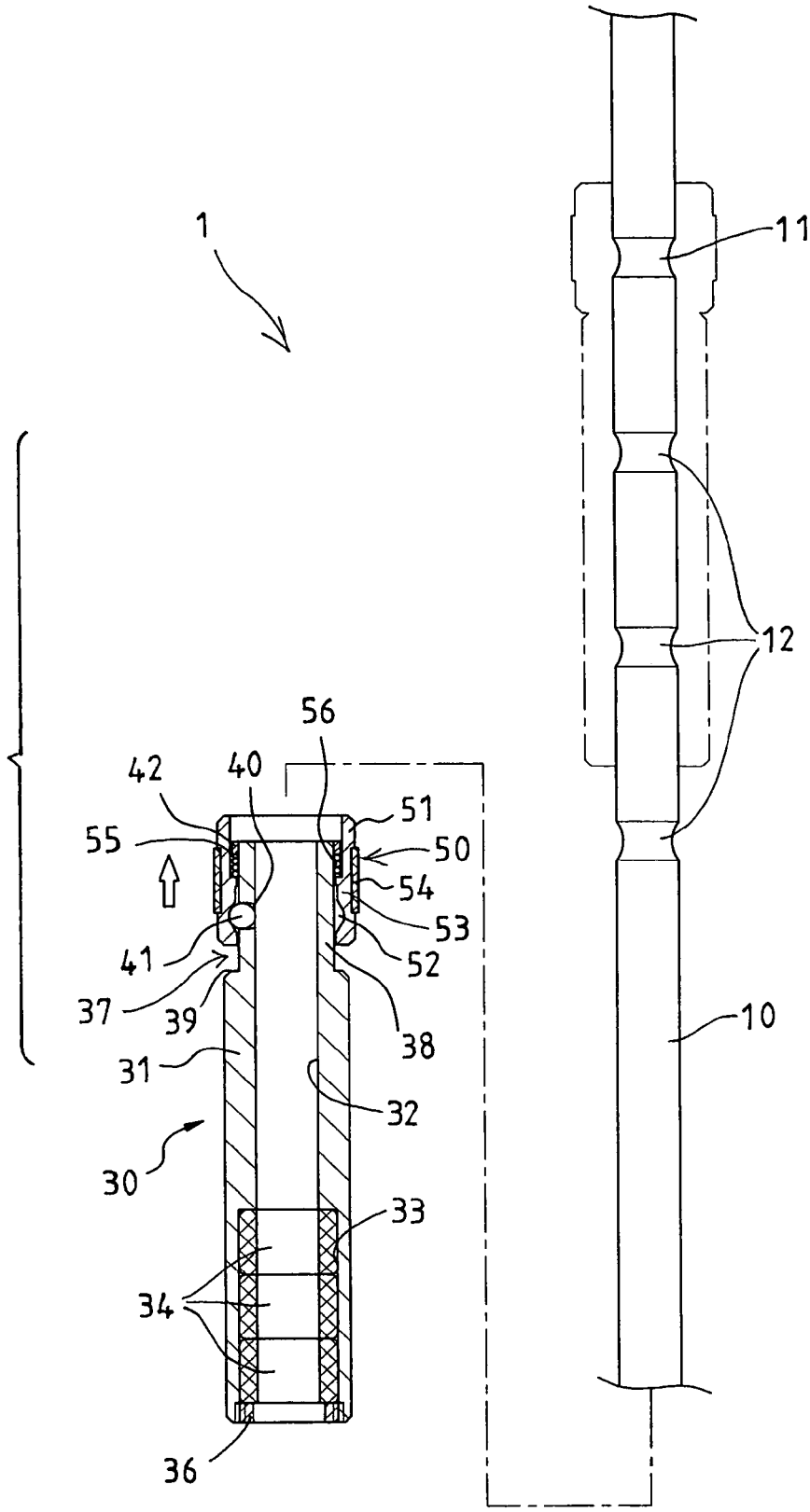
FIG. 5 is a partial plan and exploded and cross sectional view of the driving tool.

As shown in FIGS. 1 and 2, the driving stem 10 includes a driving segment or shank 13 provided in the one end or the lower portion thereof for engaging into the fasteners or the other tool members (not shown) to be rotated or driven by the driving stem 10, and includes a ball or detent 14 slidably engaged therein, and includes a longitudinal passage 15 formed therein for slidably receiving or engaging with an actuating rod 20 which is engageable with the detent 14 for selectively forcing or actuating the detent 14 to partially move out of the driving shank 13 and to engage with the fasteners or the other tool members (not shown) and to detachably attach or couple or secure the fasteners or the other tool members to the driving stem 10. The actuating rod 20 includes a depression 21 formed therein for selectively receiving the detent 14 and for allowing the detent 14 to be disengaged from the fasteners or the other tool members.

A spring member 16 is engaged in the passage 15 of the driving stem 10 and engaged with the actuating rod 20 for biasing or forcing the actuating rod 20 to engage with the detent 14 and for disengaging the depression 21 of the actuating rod 20 from the detent 14 and thus for stably coupling or securing the fasteners or the other tool members to the driving stem 10. A barrel 22 is slidably engaged onto the driving stem 10 and a bar 23 is laterally extended into the driving stem 10 and secured or engaged with the barrel 22 and also secured or engaged with the actuating rod 20 for selectively moving the actuating rod 20 relative to the driving stem 10 and against the spring member 16 and thus for allowing the detent 14 to be selectively received in the depression 21 of the actuating rod 20.

The driving shank 13 includes an opened lower portion 17 having an inner thread 18 formed therein, and one or more magnetic attracting members 24 (FIG. 2) each include an outer thread 25 formed thereon for threading or engaging with the inner thread 18 of the driving shank 13 and for detachably coupling or securing the magnetic attracting members 24 to the driving shank 13, in which the magnetic attracting members 24 may be used for acting or attracting the fasteners or the other tool members to the driving shank 13 and thus for stably coupling or securing the fasteners or the other tool members to the driving stem 10 and thus for allowing the fasteners or the other tool members to be effectively rotated or driven by the driving stem 10.

It is preferable that the tubular member 31 includes an enlarged compartment 33 formed therein and communicating with the bore 32 thereof for receiving one or more bearing devices or gaskets 34 therein in which the bearing devices or gaskets 34 may be smoothly engaged with the driving stem 10 for allowing the tubular member 31 to be smoothly moved along and rotated relative to the driving stem 10. The tubular member 31 further includes an inner thread 35 formed therein, such as formed in the lower portion thereof (FIG. 4) for threading or engaging with a locking ring 36 which may be engaged with the bearing devices or gaskets 34 (FIGS. 2, 5) for stably anchoring and retaining the bearing devices or gaskets 34 in the tubular member 31 and for preventing the bearing devices or gaskets 34 from being removed or disengaged from the tubular member 31.

The tubular member 31 further includes an outer peripheral recess 37 formed in the upper and outer peripheral portion thereof for forming a diameter-reduced neck portion 38 and for forming a peripheral shoulder 39 in the tubular member 31 or between the diameter-reduced neck portion 38 and the tubular member 31, or the tubular member 31 includes a diameter-reduced neck portion 38 formed in the upper portion thereof for forming an outer peripheral recess 37 and a peripheral shoulder 39 in the tubular member 31. The tubular member 31 further includes an orifice 40 laterally formed therein and communicating with the outer peripheral recess 37 and the bore 32 of the tubular member 31 for slidably receiving a detent 41 therein.

An actuating means or device 50 is further provided and attached onto the tubular member 31 for selectively engaging with the detent 41 and for selectively forcing or actuating the detent 41 to engage with either of the peripheral grooves 11, 12 of the driving stem 10 in order to adjustably attach or couple or secure the tubular member 31 of the hand holding device 30 onto the driving stem 10. The actuating device 50 includes a sleeve or control ferrule 51 slidably and rotatably engaged onto the tubular member 31, such as engaged onto the diameter-reduced neck portion 38 of the tubular member 31 and having an inner peripheral depression 52 for selectively receiving the detent 41 therein (FIG. 5) and for allowing the detent 41 to be selectively disengaged from the peripheral grooves 11, 12 of the driving stem 10 and thus for allowing the tubular member 31 to be moved or slid or adjusted along the driving stem 10.

Figure 8:
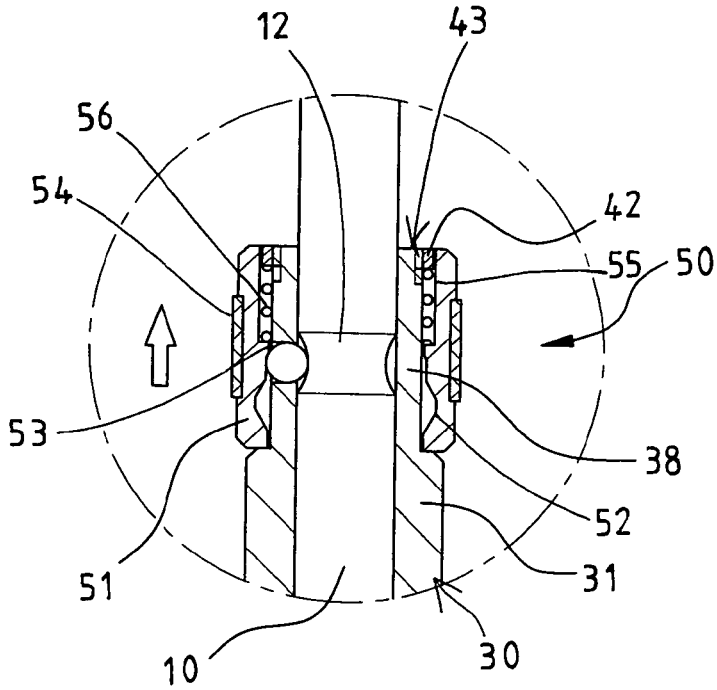
FIG. 8 is an enlarged partial cross sectional view illustrating the still further arrangement of the driving tool.

The control ferrule 51 includes a peripheral actuator 53 extended therein or provided thereon or formed by the inner peripheral depression 52, or includes the inner peripheral depression 52 formed therein for forming or defining the peripheral actuator 53, the peripheral actuator 53 may be selectively engaged with the detent 41 (FIGS. 2, 8) for selectively forcing or actuating the detent 41 to engage with either of the peripheral grooves 11, 12 of the driving stem 10 and for adjustably attaching or coupling or securing the tubular member 31 of the hand holding device 30 onto the driving stem 10 at any selected position and for preventing the tubular member 31 from being removed or disengaged from the driving stem 10. It is further preferable that the tubular member 31 includes a soft or resilient outer covering 54 formed or provided on the outer peripheral portion thereof and made of such as rubber or synthetic materials for allowing the tubular member 31 to be comfortably and stably or solidly grasped or held by the user.

The control ferrule 51 further includes an inner peripheral space 55 formed therein for receiving a spring member 56 which may be engaged with the tubular member 31 for biasing or forcing the actuator 53 of the control ferrule 51 to engage with the detent 41 or for allowing the detent 41 to be disengaged from the peripheral grooves 11, 12 of the driving stem 10. The tubular member 31 includes a clamping or retaining ring 42 attached thereto with such as a force-fitted engagement or by an adhesive material, and engaged with the spring member 56 for stably or solidly retaining the spring member 56 between the tubular member 31 and the control ferrule 51 (FIGS. 2, 5, 8) and for allowing the spring member 56 to suitably bias or force the actuator 53 of the control ferrule 51 to engage with the detent 41.

Figure 7:
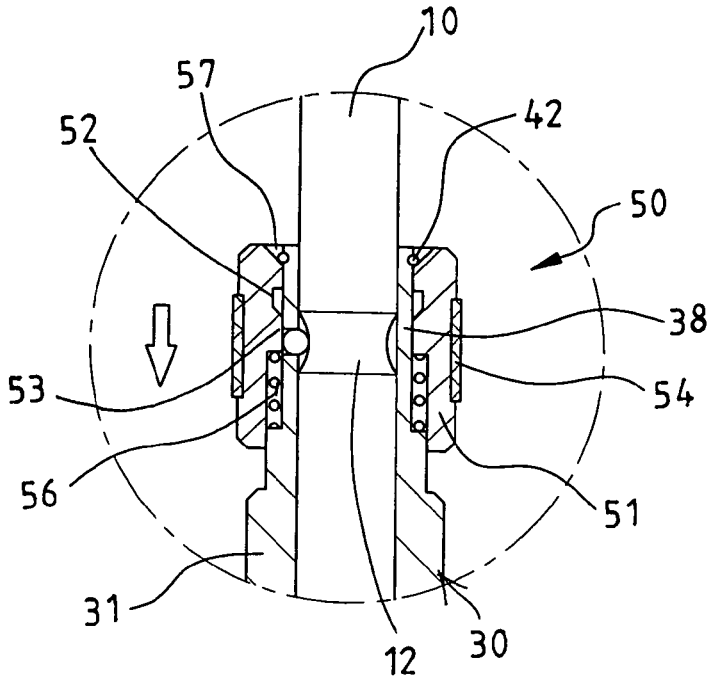
FIG. 7 is an enlarged partial cross sectional view illustrating the still further arrangement of the driving tool.

Alternatively, the retaining ring 42 may be attached or secured onto the tubular member 31 with such as a threading engagement 43 (FIG. 8) for allowing the retaining ring 42 to be detachably secured to the tubular member 31. Further alternatively, the control ferrule 51 may be disposed up side down relative to the tubular member 31 as shown in FIG. 7, and the tubular member 31 may further include a peripheral notch 57 formed therein for selectively receiving the retaining ring 42 which may be engaged with the control ferrule 51 for limiting the control ferrule 51 to move or to slide relative to the tubular member 31. The spring member 56 may also be used to bias or force the actuator 53 of the control ferrule 51 to engage with the detent 41.

In operation, when the control ferrule 51 is released by the user, the spring member 56 may bias or force the actuator 53 of the control ferrule 51 to engage with the detent 41 and to selectively force or actuate the detent 41 to engage with either of the peripheral grooves 11, 12 of the driving stem 10 in order to adjustably attach or couple or secure the tubular member 31 of the hand holding device 30 onto the driving stem 10 at any selected or suitable position. The user may grasp or hold the tubular member 31 when the driving stem 10 is driven or rotated relative to the tubular member 31. The tubular member 31 may be moved along or adjusted relative to the driving stem 10 to the other selected or suitable position when the control ferrule 51 is moved relative to the tubular member 31 against the spring member 56 and when the detent 41 is selectively received in the inner peripheral depression 52 of the control ferrule 51 and when the detent 41 is selectively disengaged from the peripheral grooves 11, 12 of the driving stem 10.

Figure 6:
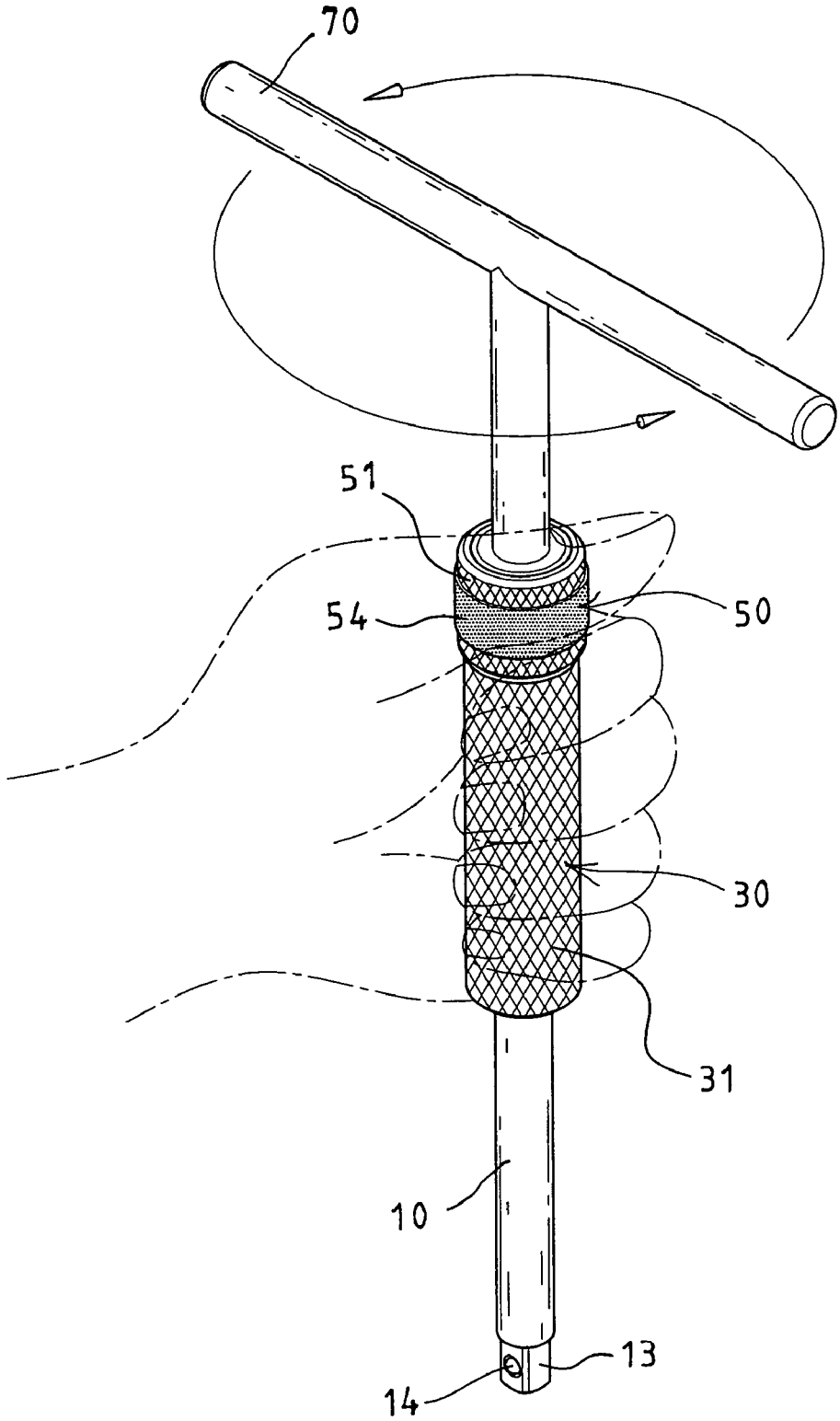
FIG. 6 is a perspective view similar to FIG. 1 illustrating the further arrangement of the driving tool.
Figure 9:
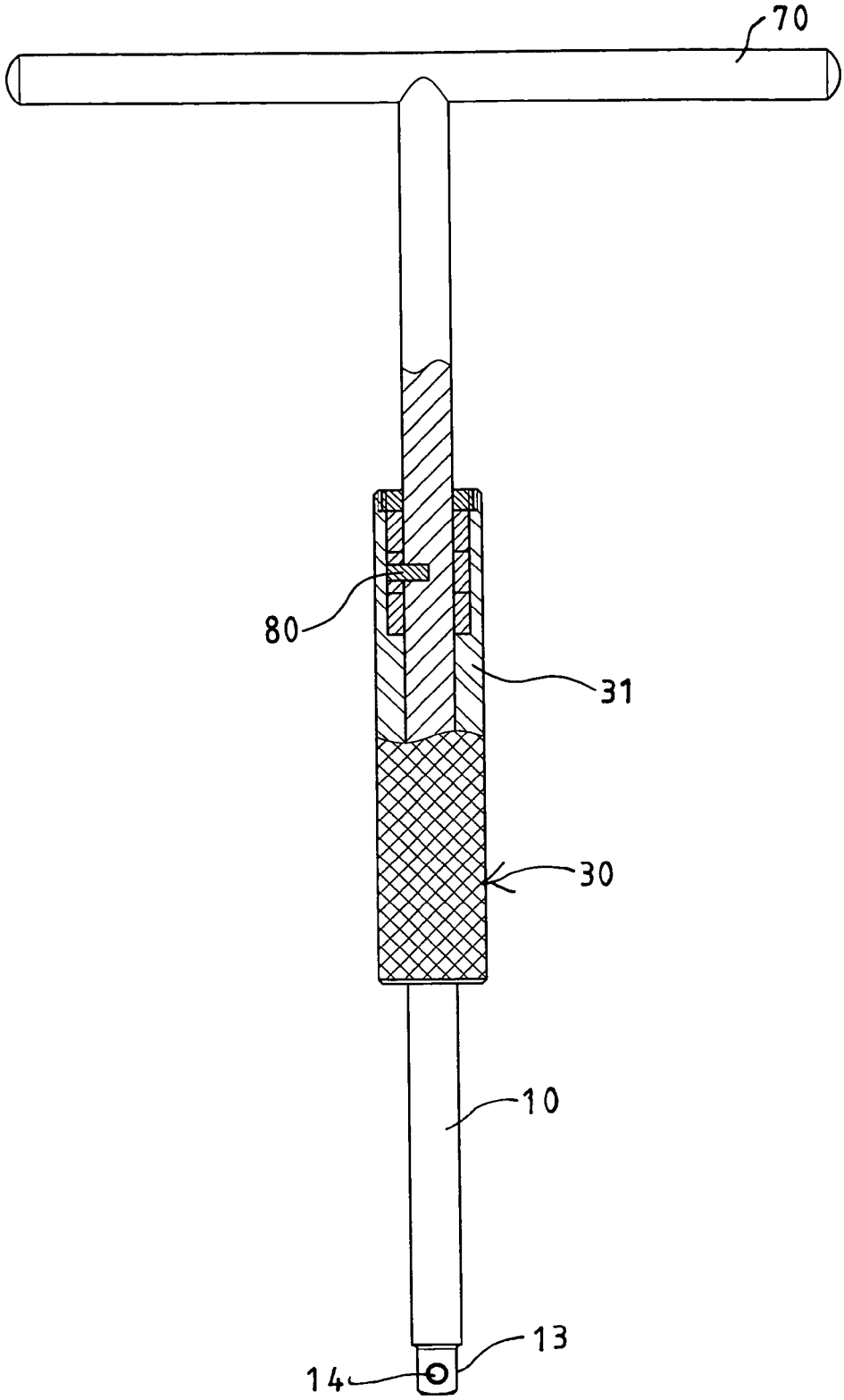
FIG. 9 is a plan schematic view illustrating the still further arrangement of the driving tool, in which a portion of the driving tool has been cut off for showing the inner structure of the driving tool.

The driving stem 10 includes an engaging cavity 26 formed in the upper portion thereof (FIGS. 1, 2), and one or more openings 27 also formed in the upper portion thereof, and communicating with the engaging cavity 26 of the driving stem 10 for detachably coupling or securing or attaching a handle 70 to the driving stem 10 and thus for allowing the driving stem 10 to be effectively rotated or driven by the handle 70. Alternatively, the handle 70 may also be solidly secured to or firmly formed integral with the driving stem 10 as shown in FIGS. 6, 9 for allowing the driving stem 10 to be effectively rotated or driven by the handle 70. The handle 70 includes a stud 71 provided in the lower portion thereof for engaging into the engaging cavity 26 of the driving stem 10 and for solidly coupling or attaching or securing the handle 70 to the driving stem 10.

The handle 70 also includes a ball or detent 72 slidably engaged therein, and includes a longitudinal passage 73 formed therein for slidably receiving or engaging with an actuating rod 74 which is engageable with the detent 72 for selectively forcing or actuating the detent 72 to partially move out of the stud 71 and to engage with either of the openings 27 of the driving stem 10 and thus for detachably attaching or coupling or securing the stud 71 of the handle 70 to the driving stem 10. The actuating rod 74 includes a depression 75 formed therein for selectively receiving the detent 72 and for allowing the detent 72 to be selectively disengaged from the driving stem 10.

Another spring member 88 is engaged in the passage 73 of the stud 71 and engaged with the actuating rod 74 for biasing or forcing the actuating rod 74 to engage with the detent 72 and for disengaging the depression 75 of the actuating rod 74 from the detent 72 and thus for stably coupling or securing the stud 71 to the driving stem 10. A barrel 76 is slidably engaged onto the stud 71 and a bar 77 is laterally extended into the stud 71 and secured or engaged with the barrel 76 and also secured or engaged with the actuating rod 74 for selectively moving the actuating rod 74 relative to the stud 71 and against the spring member 88 and thus for allowing the detent 72 to be selectively received in the depression 75 of the actuating rod 74.

Alternatively, as shown in FIG. 3, the stud 71 may include a lateral hole 78 formed therein for receiving a spring-biased projection 79, without the spring-biased actuating rod 74, and the spring-biased projection 79 may also be partially moved out of the stud 71 to engage with either of the openings 27 of the driving stem 10 and thus for detachably attaching or coupling or securing the stud 71 of the handle 70 to the driving stem 10. Further alternatively, as shown in FIG. 9, the handle 70 may be solidly secured to or firmly formed integral with the driving stem 10, and the tubular member 31 of the hand holding device 30 may include a key member 80 engaged into the driving stem 10 for rotatably coupling or securing the hand holding device 30 to the driving stem 10 and for allowing the driving stem 10 to be smoothly rotated relative to the hand holding device 30 when the hand holding device 30 is grasped or held by the user.

It is to be noted that the tubular member 31 of the hand holding device 30 may be moved or slid or adjusted along the driving stem 10 to any suitable or selected position for allowing the user to hold the suitable or selected position of the driving stem 10 and thus for allowing the driving stem 10 to be easily and effectively rotated or driven by the user.

Accordingly, the driving tool includes a hand holding device adjustably attached to a driving stem for allowing the user to hold the driving tool at any suitable or selected position when the driving stem is driven or rotated relative to the tubular member.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A driving tool comprising:

a driving stem including a first peripheral groove and at least one second peripheral groove formed in an outer peripheral portion thereof, and including a driving shank provided on one end thereof, and including an engaging cavity formed at an opposite end, a handle including a stud for selectively engaging into said engaging cavity of said driving stem and for selectively rotating and driving said driving stem, a holding device including a tubular member having a bore formed therein for slidably receiving said driving stem and for allowing said tubular member to be moved along said driving stem between said ends, said tubular member including an orifice formed therein and communicating with said bore of said tubular member, a detent slidably received in said orifice of said tubular member, an actuating device including a control ferrule slidably engaged onto said tubular member and having an actuator provided on said actuating device for engaging with said detent and for selectively actuating said detent to engage with either of said first peripheral groove or said at least one second peripheral groove of said driving stem and for adjustably attaching said tubular member of said holding device onto said driving stem at a selected position, said tubular member including a compartment formed therein and communicating with said bore thereof for receiving at least one gasket, said at least one gasket is engaged between said driving stem and said tubular member, and a locking ring engaged with said at least one gasket and retaining said at least one gasket in the tubular member.

2. The driving tool as claimed in claim 1, wherein said control ferrule includes an inner peripheral depression formed therein for selectively receiving said detent and for allowing said detent to be selectively disengaged from said first and said at least one second peripheral grooves of said driving stem and for allowing said tubular member to be moved or adjusted along said driving stem.

3. The driving tool as claimed in claim 1, wherein said control ferrule includes a spring member received therein for engaging with said tubular member and for biasing said actuator of said control ferrule to engage with said detent.

4. The driving tool as claimed in claim 3, wherein said tubular member includes a retaining ring attached thereto and engaged with said spring member for retaining said spring member between said tubular member and said control ferrule.

5. The driving tool as claimed in claim 1, wherein said control ferrule includes a soft outer covering provided on an outer peripheral portion thereof for being comfortably held by a user.

6. The driving tool as claimed in claim 1, wherein said tubular member includes an outer peripheral recess formed in an outer peripheral portion thereof for forming a diameter-reduced neck portion and for slidably engaging with said control ferrule.

7. The driving tool as claimed in claim 1, wherein said driving stem includes a second detent slidably engaged in said driving shank, and an actuating rod slidably engaged in said driving shank and engageable with said second detent for selectively actuating said second detent to partially move out of said driving shank.

8. The driving tool as claimed in claim 7, wherein said actuating rod includes a depression formed therein for selectively receiving said second detent and for allowing said second detent to be selectively engaged into said driving shank.

9. The driving tool as claimed in claim 8, wherein said driving stem includes a spring member received therein for engaging with said actuating rod and for biasing said actuating rod to engage with said second detent.

10. The driving tool as claimed in claim 9, wherein said driving stem includes a barrel slidably engaged onto said driving stem and a bar extended into said driving stem and engaged with said barrel and engaged with said actuating rod for selectively moving said actuating rod relative to said driving stem and against said spring member and for allowing said second detent to be selectively received in said depression of said actuating rod.

11. The driving tool as claimed in claim 1, wherein said driving stem includes at least one magnetic attracting member detachably attached thereto.

12. The driving tool as claimed in claim 11, wherein said driving stem includes an opened lower portion having an inner thread formed therein, and said at least one magnetic attracting member includes an outer thread formed thereon for engaging with said inner thread of said driving shank and for coupling said at least one magnetic attracting member to said driving stem.

13. The driving tool as claimed in claim 1, wherein said handle includes a third detent slidably engaged in said stud, and an actuating rod slidably engaged in said stud and engageable with said third detent for selectively actuating said third detent to partially move out of said stud.

14. The driving tool as claimed in claim 13, wherein said actuating rod includes a depression formed therein for selectively receiving said third detent and for allowing said third detent to be selectively engaged into said stud.

15. The driving tool as claimed in claim 14, wherein said handle includes a spring member received in said stud for engaging with said actuating rod and for biasing said actuating rod to engage with said third detent.

16. The driving tool as claimed in claim 15, wherein said handle includes a barrel slidably engaged onto said stud and a bar extended into said stud and engaged with said barrel and engaged with said actuating rod for selectively moving said actuating rod relative to said driving stem and against said spring member and for allowing said third detent to be selectively received in said depression of said actuating rod.

17. The driving tool as claimed in claim 1, wherein said driving stem includes at least one opening formed in said driving stem and communicating with said engaging cavity of said driving stem for detachably coupling said stud of said handle to said driving stem.

* * * * *